US005465588A

United States Patent [19]

McCahill et al.

[11] Patent Number: 5,465,588

[45] Date of Patent: Nov. 14, 1995

[54] MULTI-FUNCTION SELF-CONTAINED HEAT PUMP SYSTEM WITH MICROPROCESSOR CONTROL

[75] Inventors: David I. McCahill, Champion; Gary E. Valli, Export, both of Pa.

[73] Assignee: Hydro Delta Corporation, Monroeville, Pa.

[21] Appl. No.: 252,104

[22] Filed: Jun. 1, 1994

[51] Int. Cl.[6] ..... F25B 29/00

[52] U.S. Cl. ..... 62/127; 62/160; 62/201; 62/238.7; 62/324.6; 165/29

[58] Field of Search ..... 62/126, 127, 129, 62/130, 230, 228.3, 201, 203, 238.6, 238.7, 160, 324.6; 165/29; 237/2 B

[56] References Cited

U.S. PATENT DOCUMENTS

| | | | |
|---|---|---|---|
| 2,934,913 | 5/1960 | Haines et al. | 62/203 X |
| 4,256,475 | 3/1981 | Schafer | 165/29 X |
| 4,380,156 | 4/1983 | Ecker | 62/324.6 X |
| 4,399,664 | 8/1983 | Derosier | 62/238.7 |
| 4,528,822 | 7/1985 | Glamm | 62/238.7 |
| 4,592,206 | 6/1986 | Yamazaki et al. | 62/160 |
| 4,646,537 | 3/1987 | Crawford | 62/238.6 |
| 4,693,089 | 9/1987 | Bourne et al. | 62/238.7 X |
| 4,727,727 | 3/1988 | Reedy | 62/238.6 |
| 4,856,578 | 8/1989 | McCahill | 165/29 |
| 5,081,846 | 1/1992 | Dudley et al. | 62/160 X |

*Primary Examiner*—Harry B. Tanner

*Attorney, Agent, or Firm*—Webb Ziesenheim Bruening Logsdon Orkin & Hanson

[57] ABSTRACT

The present invention is directed to a heat pump system and more particularly to a self-contained heat pump system incorporating a microprocessor based control system, a desuperheater, a dedicated refrigerant-potable water heat exchanger, a refrigerant-air heat exchanger, and an external source-refrigerant heat exchanger wherein said heat pump system is simultaneously or alternatively capable of: heating potable water; air conditioning; heating; and dehumidification.

29 Claims, 6 Drawing Sheets

MULTI-FUNCTION SELF-CONTAINED HEAT PUMP SYSTEM WITH MICROPROCESSOR CONTROL

BACKGROUND OF THE INVENTION

1. Field of the Invention

The present invention is directed to a heat pump system and more particularly to a self-contained heat pump system incorporating a microprocessor based control system, a desuperheater, a dedicated refrigerant-potable water heat exchanger, a refrigerant-air heat exchanger, and an external source-refrigerant heat exchanger wherein said heat pump system is simultaneously or alternatively capable of: heating potable water; air conditioning; heating; and dehumidification.

2. Description of the Prior Art

A conventional heat pump involves the process of transferring heat either to (i.e. to heat a conditioned environment) or from (i.e. to cool a conditioned environment) a first temperature reservoir to a second temperature reservoir, expending mechanical energy in the process. A heat transfer medium operating within the heat pump, generally known as a refrigerant, operates to carry the heat either to or from the first temperature reservoir to the second temperature reservoir through the absorption and expulsion of heat energy, which often is accompanied by phase changes in the heat transfer medium (for example from a vapor phase to a liquid phase and back to a vapor phase).

To accomplish this transfer of heat, the heat transfer medium is subjected to a cycle of:

compression of its vapor phase;

expulsion of heat resulting in condensation to a high pressure liquid phase, expansion resulting in a low pressure vapor/liquid phase mixture; and evaporation and the absorption of heat and phase change to a vapor.

It will be appreciated that conventional heat pump units are designed to utilize the same components in the operation of both the cooling cycle and heating cycle.

Temperature reservoirs for the heat pump may include such varied external sources as the air, water, earth, solar energy or waste heat. The selection of the external source of the temperature reservoir is dependent upon the prevailing climate, topography and performance characteristics desired from the heat pump. For example, air is plentiful and easily available but heat pump heat-output capacity and efficiency decrease as the heating requirements increase on the one hand and the outdoor temperature drops on the other hand.

POTABLE WATER HEATING

To provide the added capability of potable water heating, conventional heat pumps typically incorporate an additional heat transfer medium-potable water heat exchanger. The additional heat exchanger is usually added between the compressor and reversing valve. With the heat transfer medium and potable water heat exchanger in this position, the highest temperature of the heat transfer medium is always provided to heat the potable water.

DISADVANTAGES OF PRIOR ART HEAT PUMP SYSTEMS

It was a disadvantage of prior art heat pump systems that potable water heating could only occur when the heat pump was otherwise operating in either a heating or cooling cycle to heat or cool a conditioned space. It will be appreciated that in most climates, heating and cooling occur only half of the time during the course of a year. Therefore, when the heating and cooling requirements of a home, office or other similar buildings having conditioned spaces are satisfied, the heat pump is not operating and hot potable water could not be produced with prior art heat pumps.

Another disadvantage of the prior art heat pump systems having potable water heating capability, is that the amount of heat available for heating the conditioned space is reduced when the heat pump system must simultaneously provide potable hot water heating and conditioned space heating. Most of the heat available in the hot vapor phase of the heat transfer medium after the compression step, is absorbed by the potable hot water heating system. Therefore, to provide adequate potable hot water heating capability and conditioned space heating, the compressor unit had to be oversized resulting in an inefficient heat pump unit.

Another one of the disadvantages of the prior art as it pertained to water heating was that potable hot water had to be heated to at least 130° F. to provide enough hot water in a hot water storage tank so that during periods of peak usage, enough draw down of hot water would be provided for lengthy showers and the like. Heating water to 130° F. mandated that the heat transfer medium vapor phase temperature had to be elevated to a much higher than normal operating condition in order to raise the water temperature to 130° F. The most common way to elevate the heat transfer medium's vapor phase temperature, is to increase the compressor's discharge pressure to greater and greater pressures (also known as "head pressures). Over a prolonged period of time, the excessive compressor discharge pressure and temperature requirements of a dedicated potable water heating system significantly shortens the life expectancy of the compressor.

A multi-function heat pump as described in the prior art, U.S. Pat. No. 4,856,578, issued Aug. 15, 1989 entitled "Multi-Function Self-Contained Heat Pump System" (hereinafter "the '578 heat pump system") is capable of space heating, space cooling and domestic water heating (i.e. potable hot water heating), all in one appliance. The '578 multi-function heat pump system provides hot potable water regardless of whether the heat pump system is otherwise heating or cooling conditioned spaces.

One disadvantage of the prior art '578 heat pump system, is that each mode of operation (heating, cooling and potable water heating) is independent of each other, and only one mode can operate at a time. Each mode of operation requires the energizing of different apparatus and, therefore it is necessary to prioritize which function will override the other when the condition existed in which two or more modes of operation were called for at the same time (i.e. simultaneously attempting to heat water and heat a conditioned space). Another disadvantage of the '578 heat pump system is that it uses electro-mechanical relays to switch each control device with a set sequence of operation.

In none of the previously disclosed art is there a heat pump capable of simultaneously operating in more than one mode of operation.

SUMMARY OF INVENTION

It is the object of this invention to provide a simplified heat transfer medium circuit for a multifunction heat pump system having the capability of:

(1) heating or cooling conditioned spaces; or (2) heating potable water only without space cooling or space heating, or (3) simultaneously space cooling and potable water heating, or (4) simultaneously space heating and potable water heating.

It is another object of this invention to provide a means for service troubleshooting said heat pump system.

It is another object of the present invention to provide a means to record operating data associated with said heat pump system.

It is still another object of the present invention to provide a means to reduce energy consumption of a heat pump system.

It is another object of the present invention to provide a means to display all functions and data associated with said heat pump system to a remote display terminal.

The objects and advantages of the present invention are achieved by providing a heat pump unit for heating or cooling a conditioned space, further including simultaneous potable water heating capability.

Generally, the present invention comprises a heat pump system comprising:

(1) a dedicated heating mode or cycle;

(2) a dedicated cooling mode or cycle;

(3) a dedicated water heating mode or cycle (to heat water only);

(4) a partial water heating mode or cycle comprising a desuperheater; and (5) a microprocessor to prioritize the simultaneous demands on each of the above modes or cycles.

More particularly, the heat pump system of the present invention has a compressor with a service port, an entrance port and a discharge. A refrigerant condenser (desuperheater) is connected to the discharge of the compressor, and a three-way valve is connected to the discharge of the desuperheater. A reversing valve is connected to the three-way valve and to the compressor entrance port. A refrigerant-air heat exchanger is connected to the reversing valve outlet and an external source-refrigerant heat exchanger is connected to the reversing valve with a refrigerant-potable water heat exchanger connected to the three-way valve. The heat pump unit also includes a refrigerant-control device interposed between the external source-refrigerant heat exchanger and the refrigerant-air heat exchanger, a first bi-flow valve interposed between the refrigerant-control device and the refrigerant-potable water heat exchanger, and a second bi-flow valve interposed between the refrigerant-control device and the refrigerant-air heat exchanger. The refrigerant-potable water heat exchanger produces hot water regardless of the heating or cooling operation of the heat pump.

The heat pump system of the present invention also includes a microprocessor control apparatus utilizing input sensing devices to control simultaneous demands for each mode or cycle, to achieve maximum energy efficiency.

Further features and other objects and advantages of this invention will be understood from the following detailed description made with reference to diagrams, flow charts, drawings, and schematics.

DESCRIPTION OF THE PREFERRED EMBODIMENTS

Figure 1:
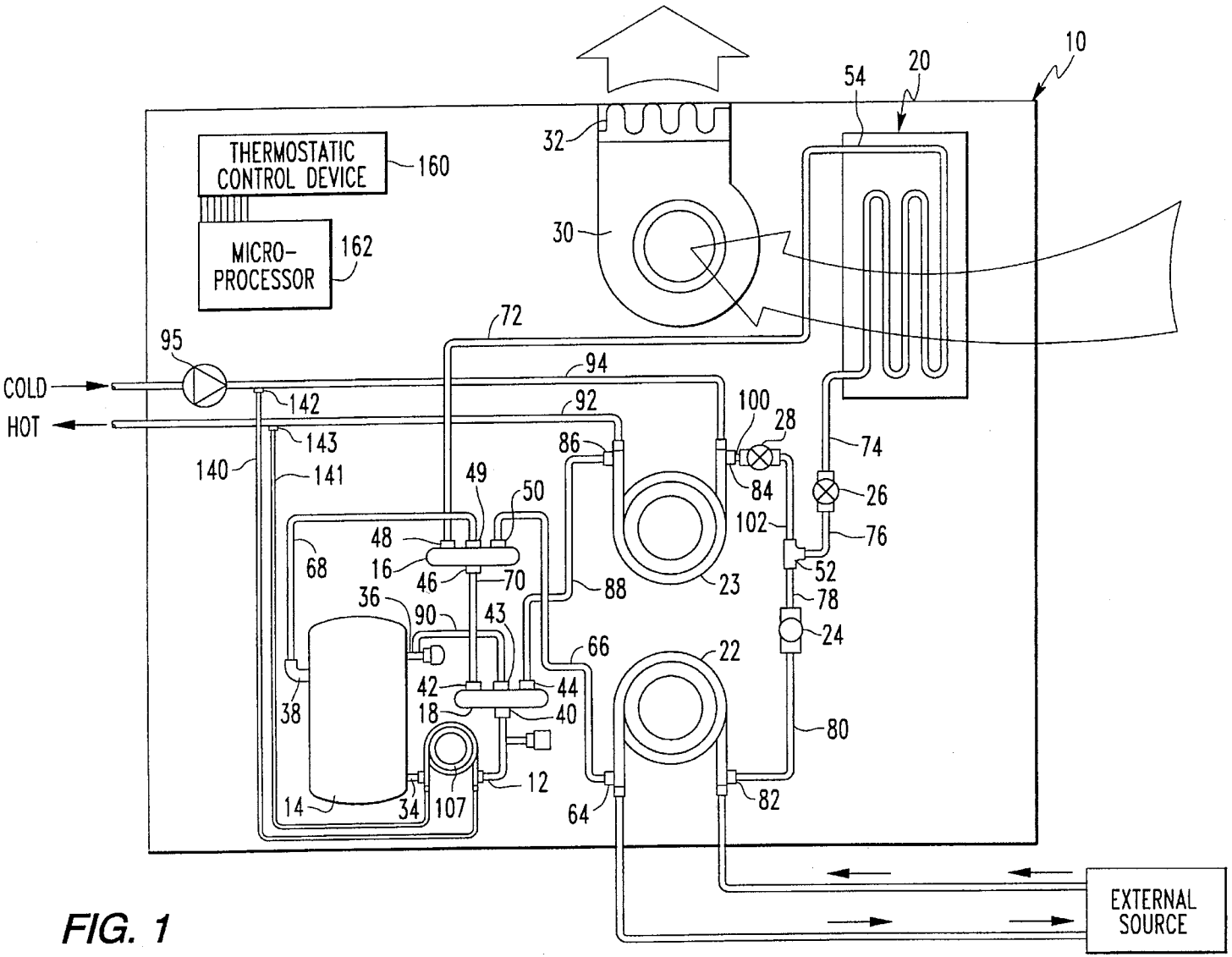
FIG. 1 is a diagram of the heat pump of the present invention.

The present invention relates generally to the previous refrigerant circuitry art taught by U.S. Pat. No. 4,856,578, and to the extent necessary to complete this disclosure, U.S. Pat. No. 4,856,578 is hereby incorporated herein by reference. Further, in the following discussion, the term "refrigerant" will be used in place of heat transfer medium for the sake of brevity, but the terms are synonymous unless the context indicates otherwise.

Referring now to the drawings wherein like reference characters represent like elements, FIGS. 1–4 and 6–7 illustrate the heat pump unit 10.

GENERAL OVERVIEW OF COMPONENTS

The heat pump unit 10 of the present invention includes a system of piping interconnecting a compressor 14, refrigerant-air heat exchanger 20, external source-refrigerant heat exchanger 22, refrigerant-potable water heat exchanger 23, desuperheater 107, refrigerant control device 24 which converts warm liquid refrigerant to a cold liquid by rapid expansion of the refrigerant from a high pressures area to a low pressure area (also known as a metering valve or an expansion valve), a valve means for circulating refrigerant from the potable water heating cycle position to the heating and cooling cycle position in cooperation with a blower 30, electrical resistance heating elements 32, and thermostatic control 160 and microprocessor 162. The valve means includes a reversing valve 16, a three-way valve 18, a first bi-flow valve 26 and a second bi-flow valve 28 for circulating the refrigerant. The individual components making up the heat pump are of a type and design commonly used in conventional heat pump units. In a preferred embodiment, the first bi-flow valve 26 and second bi-flow valve 28 are solenoid bi-flow valves.

Because of the overall design of the present unit, the compressor size may be substantially reduced while not affecting the amount of heating, cooling and potable water heating produced when compared to conventional heat pump units. Moreover, the heat pump unit of the present invention is capable of continuously providing hot potable water regardless of whether the thermostatic control 160 calls for either the heating cycle or cooling cycle.

As shown in FIG. 1, heat pump unit 10 includes compressor 14, which includes a discharge port 34, a service port 36 and an entrance port 38. The discharge port 34 is connected to desuperheater 107 and thence through pipe 12 to three way valve 18 via first inlet port 40. The three way valve 18 includes three outlet ports 42, 43 and 44.

Outlet port 42 of the three way valve 18 is connected via pipe 70 to the reversing valve 16 through a second inlet port 46. Outlet port 43 of three way valve 18 is connected via pipe 90 to the service port 36 of the compressor 14. Outlet port 44 of three way valve 18 is connected via pipe 88 to port 86 of the refrigerant-potable water heat exchanger 23.

The reversing valve 16 also includes three orifices 48, 49 and 50. Orifice 48 is connected via pipe 72 to a refrigerant-air coil 54 of the refrigerant-air heat exchanger 20. Orifice 49 is connected via pipe 68 to the entrance port 38 of the compressor 14. Orifice 50 is connected via pipe 66 to port 64 of the external source-refrigerant heat exchanger 22.

The refrigerant-air coil 54 of the refrigerant-air heat exchanger 20 is connected via pipe 74 to a first bi-flow valve 26 which in turn is connected via pipe 76 to a first end of a T-pipe fitting 52.

The external source-refrigerant heat exchanger 22 is also connected to a second end of T-pipe fitting 52 pipe 78 to refrigerant-control device 24 to pipe 80 to port 82.

The refrigerant-potable water heat exchanger 23 is connected to a second bi-flow valve 28 via port 84 and pipe 100, and second bi-flow valve 28 is in turn connected to the third end of T-pipe fitting 52 via pipe 102.

From the interconnection of the components of the heat pump, four separate circuits formed of a heating cycle, a cooling cycle, a dedicated potable water heating cycle, and a partial potable water heating cycle may be operatively controlled by microprocessor 162 and thermostatic control 160.

More particularly, the thermostatic control 160 and in turn the microprocessor 162 of the present invention may respond to either the temperature in the conditioned space, the hot water temperature and/or a time clock for selecting the most efficient mode of operation.

CONDITIONED SPACE HEATING CYCLE OPERATION

Figure 7:
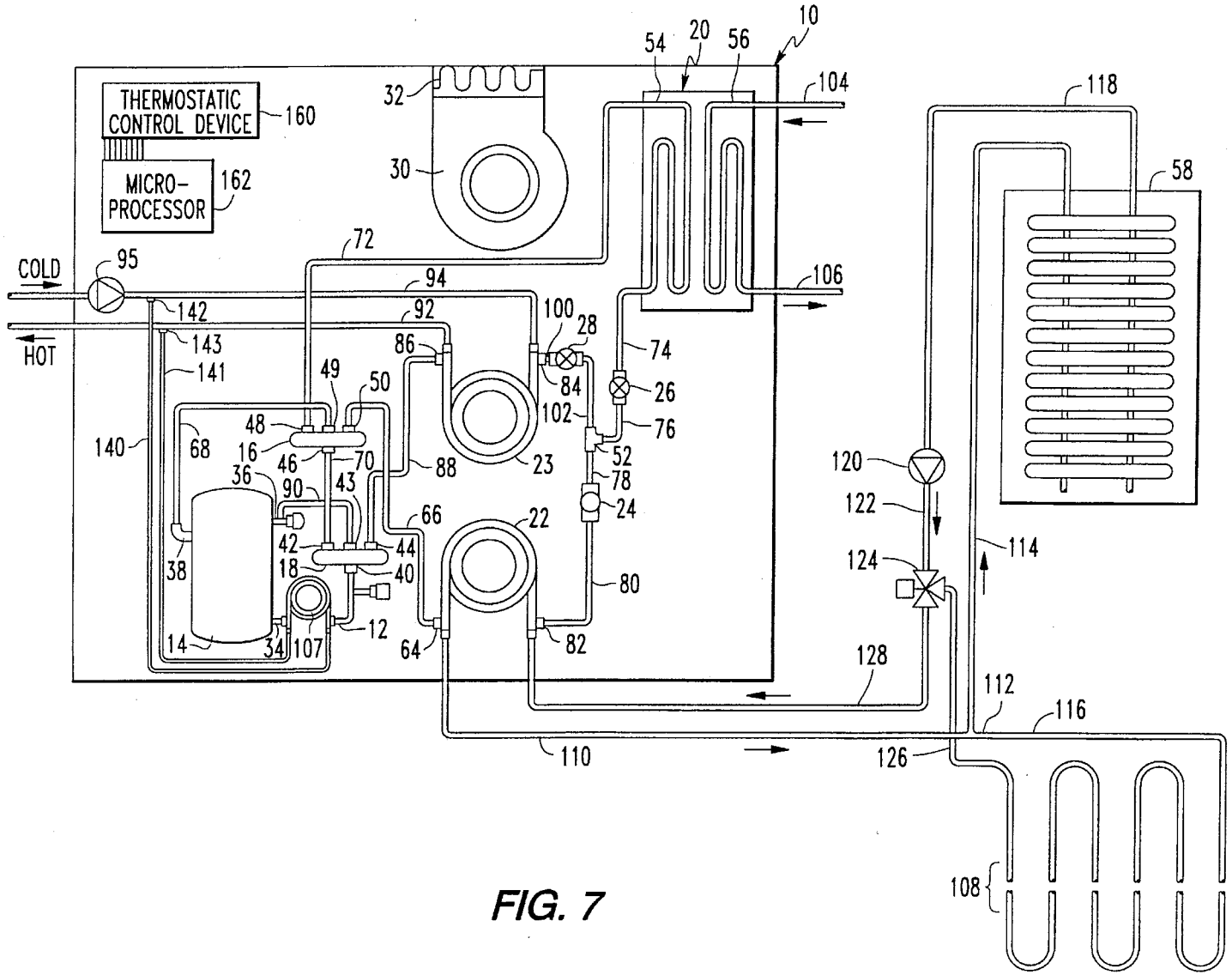
FIG. 7 is a diagram of the heat pump of the present invention including a thermal storage tank and ground loop.

In the heating cycle to heat a conditioned space, the moment the thermostatic control 160 calls for heat, the compressor 14 is activated. As the compressor begins operating, a decrease in the refrigerant suction pressure in the pipes 66 and 68 connecting the compressor and the external source-refrigerant heat exchanger 22 causes low temperature refrigerant to enter the external source-refrigerant heat exchanger 22 and absorb heat from the higher temperature external source as follows. As shown in FIGS. 1–4, and 7, the external source-refrigerant heat exchanger 22 is a tube-in-tube heat exchanger wherein a heat transfer medium flows in an inner tube in a direction counter to the flow of the refrigerant in an outer tube, said heat transfer medium in said inner tube being in a heat exchange relationship with the external source. As used herein, "external source" refers to the external source providing thermal energy for use in the heat pump of the present invention. Various external sources of thermal energy available for use in the present invention include well water, air, lake or pond water, river water, ground water, water circulated within a closed ground loop, and solar energy and the like. FIG. 7 illustrates the use of a thermal storage tank 58 and ground loop 108 in combination as an external source.

As shown in FIG. 7, a thermal storage tank 58 and ground loop 108 are combined as an external source. A heat transfer medium, typically an antifreeze solution such as ethylene glycol and the like, is circulated from the refrigerant-liquid heat exchanger 22 via pipe 110 to a T-pipe fitting 112. From the T-pipe fitting, the transfer medium may flow either to the thermal storage tank 58 through pipe 114 or to the ground loop 108 through pipe 116. From the thermal storage tank 58, the heat transfer medium is drawn through pipe 118 by circulating pump 120. The heat transfer medium flows from circulating pump 120 via pipe 122 to a third three-way valve 124. Also connected to valve 124 is pipe 126 which in turn is connected to ground loop 108, and pipe 128 which is connected to the external source-refrigerant heat exchanger 22. Three-way valve 124, when open, allows heat transfer medium from pipe 122 of the storage tank 58 to mix with medium from the pipe 126 of the ground loop 108 and flow from together through pipe 128 to heat exchanger 22. The three way valve 124 when closed, prevents mixing of the ground loop 108 heat transfer medium and storage tank 58 heat transfer medium so that only heat transfer medium from the storage tank 58 flows to the heat exchanger 22. It will be appreciated that the temperature of the medium used in the external source-refrigerant heat exchanger 22 may be adjusted by mixing of the heat transfer mediums in the ground loop 108 and storage tank 58.

Figure 6:
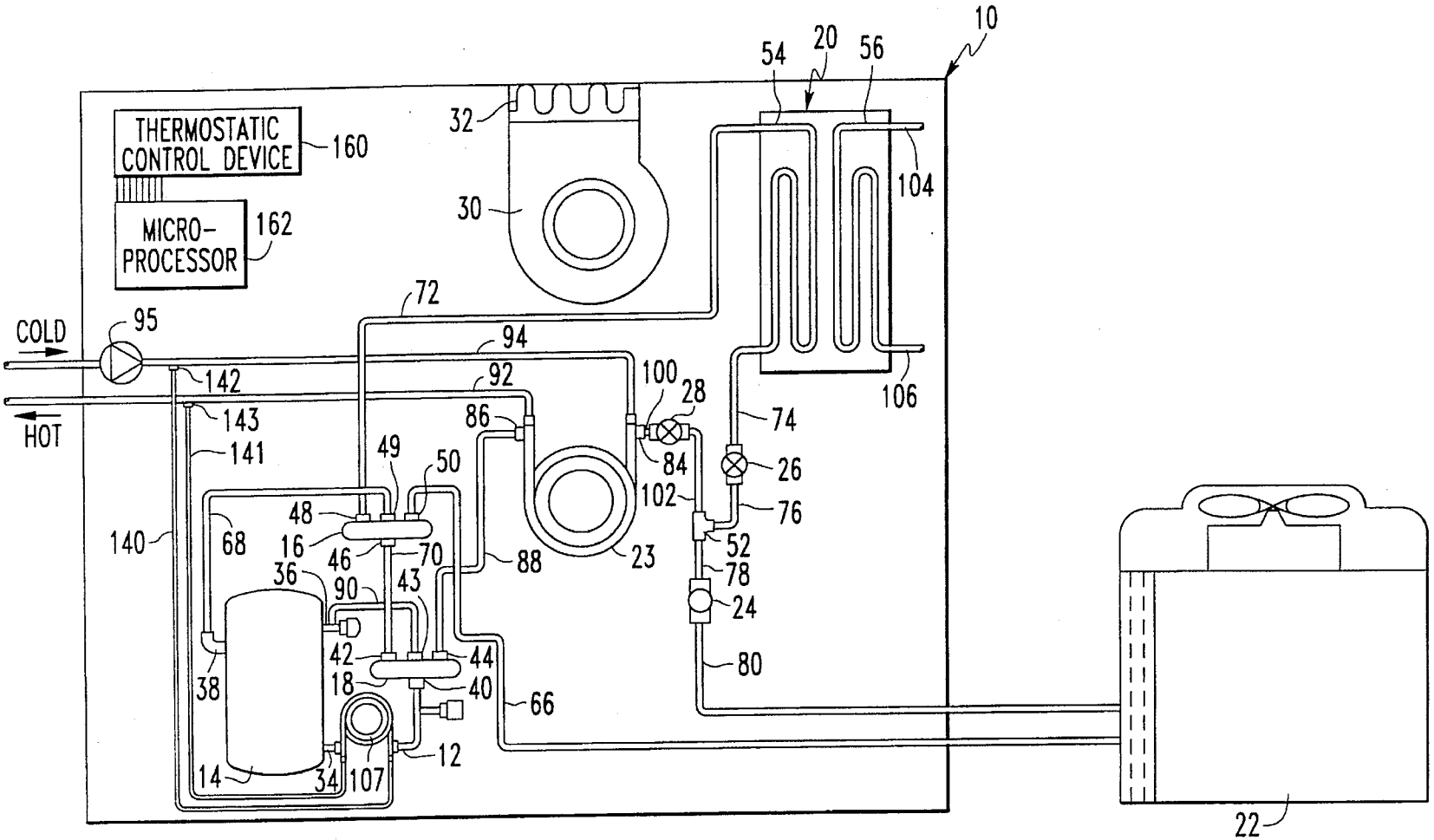
FIG. 6 is a diagram of the heat pump of the present invention including an external source-refrigerant heat exchanger positioned outside of the heat pump.

The heat transfer medium of the external source may either flow directly in the inner tube or the heat from the external source may be transferred to a medium that flows in the inner tube. For example, conventional air-to-air heat pumps transfer thermal energy from air to a refrigerant medium. As shown in FIG. 6, the external source-refrigerant heat exchanger 22 is positioned outside of the heat pump unit 10 such that the thermal energy from the surrounding air is transferred directly to the refrigerant.

Since in the heating mode the refrigerant in the outer tube in the external source-refrigerant heat exchanger 22 is under low pressure and low temperature, the refrigerant absorbs the heat from the higher temperature heat transfer medium which is in thermal association with the external source and the refrigerant undergoes a phase change to the vapor state.

The vaporized refrigerant exits external source-refrigerant heat exchanger 22 at fitting 64 and is then drawn through pipe 66, orifice 50 to reversing valve 16. From reversing valve 16, the refrigerant is directed through orifice 49 via pipe 68 and into the compressor 14 through the entrance port 38 where it is compressed and increased in temperature. The refrigerant-vapor then exits the compressor 14 through the discharge port 34 and flows to desuperheater 107 and thence through pipe 12 to the three-way valve 18 through inlet port 40. The refrigerant vapor then exits three-way valve 18 through outlet port 42 where it flows through pipe 70 to enter reversing valve 16 at inlet port 46. The refrigerant exits the reversing valve 16 via orifice 48 and travels through pipe 72 to enter the refrigerant-air coil 54 of the refrigerant-air heat exchanger 20, where the refrigerant is condensed from a vapor into a liquid at high pressure.

Cool air from the conditioned space is heated by blowing the cool air across the refrigerant-air heat exchanger 20 by the blower 30 as shown by the arrow in FIG. 1. The slightly warmer high pressure liquid refrigerant exits the refrigerant-air coil 54 and is then passed by way of pipe 74 through an open first bi-flow valve 26.

As a slightly cooler high pressure liquid, the refrigerant then flows from open bi-flow valve 26 though pipe 76 to T-pipe fitting 52. From T-pipe fitting 52 the refrigerant is directed through a refrigerant-control device 24 via pipe 78. It will be appreciated that when the heat pump unit 10 is operating in the heating cycle or cooling cycle bi-flow valve 28 is closed. Therefore, the refrigerant must flow from T-pipe fitting 52 to the refrigerant control device 24 as opposed to the refrigerant-potable water heat exchanger 23.

The refrigerant control device 24 causes a reduction in the pressure and temperature of the liquid refrigerant forming a liquid/vapor refrigerant mixture. The liquid/vapor refrigerant mixture exits refrigerant-control device 24 and returns to the external source-refrigerant heat exchanger 22 through fitting 82 and pipe 80 to begin the heating cycle again. Once the desired temperature in the conditioned space is reached, a signal is sent by the thermostatic control 160 to the compressor 14 to stop.

CONDITIONED SPACE COOLING CYCLE OPERATION

In the cooling cycle, the thermostatic control 160 responds to a temperature rise in the conditioned space to activate the compressor 14. With the compressor operating, the cold, low pressure liquid refrigerant in the refrigerant-air coil 54 of the refrigerant-air heat exchanger 20 begins to absorb heat from air blown through the refrigerant-air heat exchanger 20 by blower 30. The refrigerant is converted from a low pressure liquid to a vapor. The vaporized refrigerant is then drawn through pipe 72 and orifice 48 to the reversing valve 16. The vaporized refrigerant exits reversing valve 16 through orifice or port 49 and flows through pipe 68 to entrance port 38 into compressor 14. The refrigerant is compressed and absorbs heat in compressor 14 and is then discharged through the discharge port 34 of compressor 14 flowing through desuperheater 107 to the three-way valve 18 via pipe 12 and first inlet port 40. The refrigerant passes by way of exit port 42, pipe 70 and second inlet port 46 back through the reversing valve 16 and then through orifice 50, pipe 66 and fitting 64 to the external source-refrigerant heat exchanger 22. The hot vaporized refrigerant condenses into a warm high pressure liquid as the refrigerant is cooled by the lower temperature of the heat transfer medium in thermal association with the external source of the external source-refrigerant heat exchanger 22.

The warm high pressure liquid refrigerant then exits external source-refrigerant heat exchanger 22 through fitting 82 and passes through pipe 80 to refrigerant control device 24. Within the refrigerant control device 24, the warm high pressure liquid refrigerant is permitted to expand rapidly and is converted into a cold low pressure liquid refrigerant. Next, the cold low pressure liquid refrigerant flows from refrigerant control device 24 through pipe 78 to T-pipe fitting 52. The refrigerant is then directed through pipe 76 to the first bi-flow valve 26 and then through pipe 74 to the refrigerant-air coil 54 of the refrigerant air heat exchanger 20 where warm air from the conditioned space is again blown over the refrigerant-air heat exchanger 20. The heat from the warm air is absorbed by the cold low pressure refrigerant, cooling the conditioned space. Simultaneously, the refrigerant absorbs heat and is vaporized by the absorbed heat, and is then returned to the compressor 14 via the method detailed above reversing valve 16, to begin the cooling cycle again.

In the cooling cycle, the direction of flow of refrigerant within the external source-refrigerant heat exchanger 22 and refrigerant-air coil 54 of refrigerant-air heat exchanger 20 is reversed from that of the heating cycle by reversing valve 16 directing refrigerant through orifice 50 instead of orifice 48.

During the start up of the compressor 14 in the heating and cooling cycle, the second bi-flow valve 28 is closed and the suction formed at the entrance port 38 of the compressor completely evacuates the refrigerant from the refrigerant-potable water heat exchanger 23 and pipe 88 into exit port 44 of the three-way valve 18 and out exit port 43 through pipe 90 for use in either the heating or cooling cycle. Accordingly, no reservoir of refrigerant is accumulated by the refrigerated-potable water heat exchanger 23 and pipe 88 thereby assuring an adequate supply of refrigerant in the heat pump unit when operating in either the heating or cooling cycle.

POTABLE WATER HEATING CYCLE OPERATION

Combination Of Desuperheater and Dedicated Refrigerant Potable Water Heat Exchanger:

The present invention utilizes both a dedicated refrigerant-to-water heat exchanger 23 and a partial refrigerant-to-water heat exchanger in the form of a desuperheater 107 to heat potable water (or any other liquid for that matter). When potable water heating is desired or required, the microprocessor 162 utilizes either the dedicated refrigerant-to-water condenser or the desuperheater condenser or both depending upon the demands placed upon heat pump unit 10 and the ability of heat pump unit 10 to meet these demands.

For example, if the heat pump unit 10 is heating or cooling the conditioned space and the temperature of the water to be heated by heat pump unit 10 drops below a predetermined value, the microprocessor 162 of the heat pump unit 10 activates compressor 14 which furnishes compressed hot refrigerant vapor through port 34 to desuperheater 107, which will take a portion, but not all of the heat from the refrigerant vapor as it exits compressor 14, to heat the potable water to the desired temperature. One advantage of the present invention is that since the desuperheater 107 is in series with other heat exchangers, it merely lowers the temperature (or removes a portion of the heat) of the refrigerant hot gas without actually condensing the hot gas into a liquid, and, therefore, does not require the hot gas temperature to be raised for water heating to take place, thereby keeping the discharge pressure of the compressor 14 within normal operating conditions.

The following figures are for illustration only, and are not to be construed as the exact operating temperatures of the heat pump system of the present invention. Specific temperatures will vary according to several parameters, including the pressure of the system and the nature of the refrigerant.

Thus for example, the temperature of the vapor phase of a typical refrigerant as it exits compressor 14 is often referred to as the gas discharges temperature and is typically around 160° F. The vapor phase of the refrigerant will typically condense to a liquid phase at around 110° F. Thus, the difference between 160° F. and 110° F., namely approximately 50° F., is available to the heat pump unit 10 for heating purposes before the refrigerant recondenses from a vapor to a liquid. Desuperheater 107 takes only a portion of the 50° F. of heat available from the vapor phase of the refrigerant as it exits compressor 14, and utilizes that portion to heat water. For example, where desuperheater 107 utilizes sufficient heat for water heating purposes to reduce the gas discharge temperature from 160° F. to 140° F., the result is that since the refrigerant remains in its vapor phase until it drops to 110° F., the 140° F. vapor phase temperature can be used for additional heating and cooling until the 110° F. temperature is reached whereupon the refrigerant will undergo a phase change from vapor to liquid phase. The advantage of this arrangement is that space heating or cooling operations can continue, while simultaneously heating potable water.

In addition, if the microprocessor 162 senses that the water temperature has fallen to a predetermined level at which significant water heating capability is needed, the microprocessor 162 can immediately activate both desuperheater 107 and dedicated refrigerant-water heat exchanger 23. Desuperheater 107 will again take its portion of the heat from the vapor phase of the refrigerant at it exits compressor 14 (which in the above example would result in the temperature of the vapor phase of the refrigerant being reduced from 160° F. to 140° F. The 140° F. vapor phase of the refrigerant can be redirected by the microprocessor 162 from any heating or cooling operation to the dedicated refrigerant-potable water heat exchanger 23 instead. Thus a maximum amount of heat can be utilized to heat the potable water.

Figure 2:
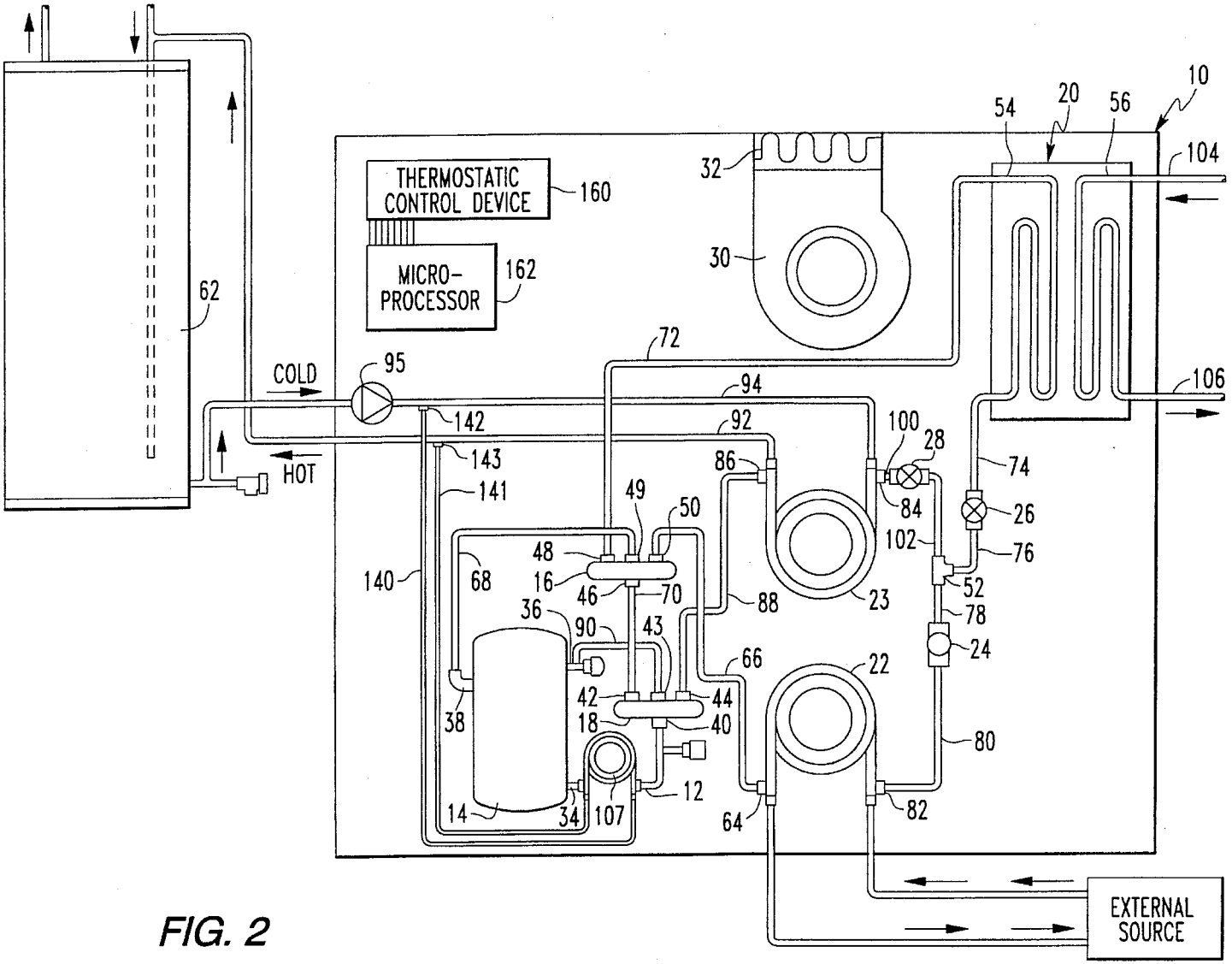
FIG. 2 is a diagram of the heat pump of the present invention including a hot water storage tank.

Use of Desuperheater only:

More particularly, in a hot water heating cycle where the desuperheater alone is required, the compressor 14 compresses the refrigerant into a hot vapor which is then discharged via discharge port 34 to desuperheater 107. In a preferred embodiment, the desuperheater 107 is a tube-in-tube heat exchanger of double-wall construction, wherein the refrigerant flows in an outer tube counter to the flow of water in an inner tube. Cold water is supplied to desuperheater 107 from pipe 94 through fitting 142 and then in an inner tube through pipe 140. After heating, the now hot water is transferred from desuperheater 107 to place of storage or usage via and returned through pipe 141 where it joins pipe 92 via T-fitting 143. As shown in FIG. 2, the hot water may be piped to and from a hot water storage tank 62 by circulating pump 95 and pipes 92 and 94, respectively.

The remaining hot vaporized refrigerant exiting desuperheater 107 through pipe 12 can be utilized for heating or cooling conditioned spaces as set out above, or it can be made to flow to refrigerant-potable water heat exchanger 23 as set out immediately below.

Use of combination of desuperheater and dedicated refrigerant-potable water heat exchanger:

In a hot water heating cycle where both the desuperheater 107 and refrigerant-potable water heat exchanger 23 are required to heat water, as for example, during peak periods of use of hot water, the compressor 14 compresses the refrigerant into a hot vapor which is then discharged via discharge port 34 to desuperheater 107. A portion of the heat in the hot vaporized refrigerant is exchanged in the desuperheater 107 to convert the relatively colder water entering the desuperheater from pipe 140 to relatively warmer water which exits desuperheater 107 through pipe 141 to be directed as needed, as for example to a hot water storage tank or a pool heater and the like as described above.

The remaining hot vaporized refrigerant exiting desuperheater 107 through pipe 12, flows to three-way valve 18 via inlet port 40, where the refrigerant is directed to the refrigerant-potable water heat exchanger 23 by way of port 44, pipe 88 and fitting 86. In a preferred embodiment, the potable water heat exchanger 23 is a tube-in-tube heat exchanger of double-wall construction, wherein the refrigerant flows in an outer tube counter to the flow of water in an inner tube supplied through pipe 94 and returned through pipe 92. In refrigerant-potable water heat exchanger 23, the hot vaporized refrigerant passes its remaining heat from its vapor phase to the water. The refrigerant then condenses to a warm high pressure liquid as it exits refrigerant-potable water heat exchanger 23.

Figure 3:
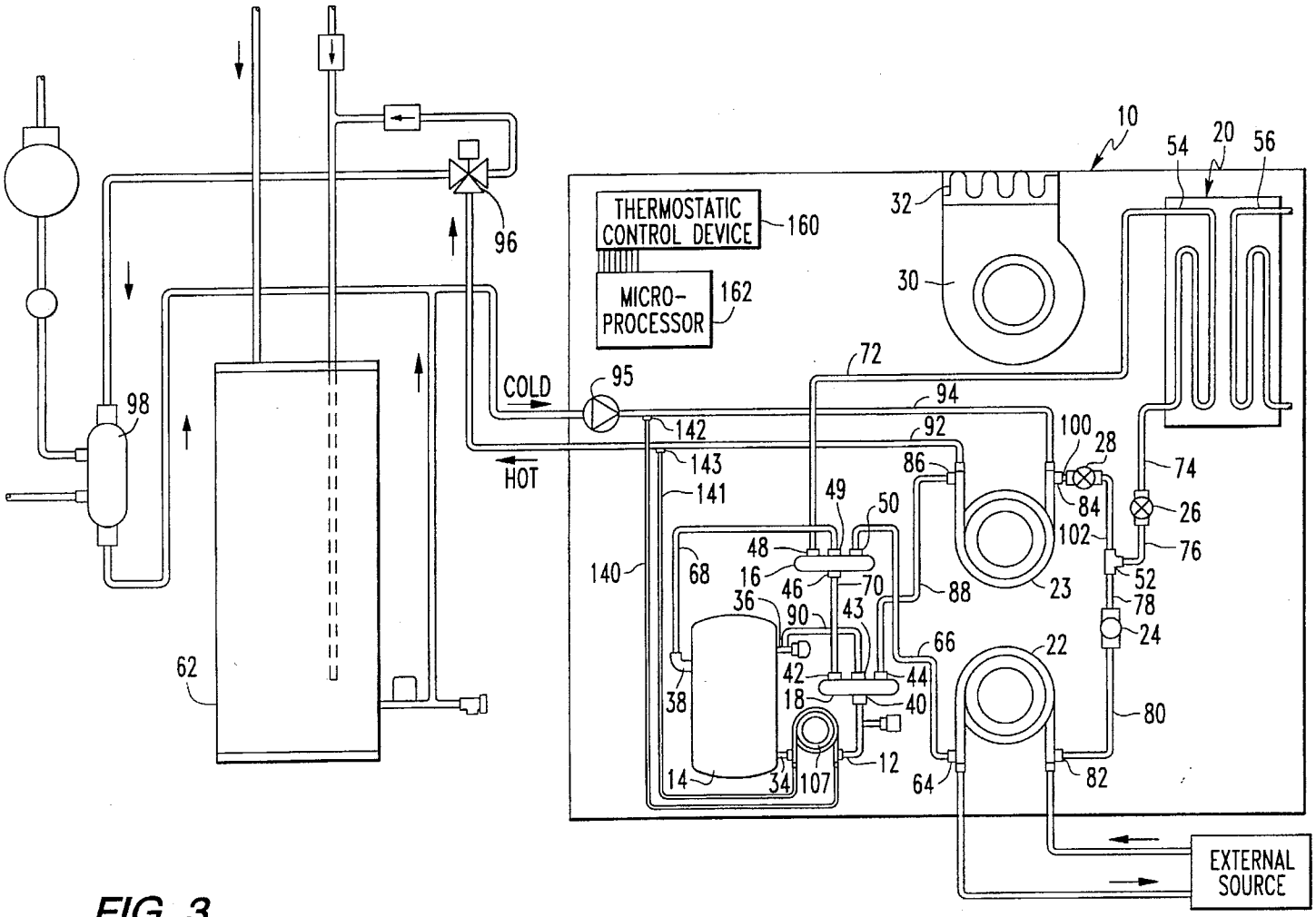
FIG. 3 is a diagram of the heat pump of the present invention including a hot water storage tank and a pool water heater.

The hot water is piped from the heat pump unit 10 through pipe 92 for a variety of domestic uses as described above. For example, as shown in FIG. 2, the hot water may be piped to a hot water storage tank 62 by circulating pump 95. It will be appreciated that hot water may also be piped to any number of external heat exchangers to provide additional heating capability. As shown in FIG. 3, hot water is piped via pipe 92 through a second three-way valve 96 to a hot water storage tank 62 and a water-water heat exchanger 98. The heat exchanger 98, of conventional design, may provide heated water for additional secondary uses such as a pool or a spa.

The condensed warm high pressure liquid refrigerant flows from refrigerant-potable water heat exchanger 23 through fitting 84, pipe 100, second bi-flow valve 28, pipe 102, T-pipe fitting 52, and pipe 78 to the refrigerant-control device 24. The refrigerant-control device 24 permits expansion of the refrigerant and converts the warm high pressure liquid refrigerant to a cold low pressure liquid. The cold low pressure liquid refrigerant exiting from refrigerant control device 24 then passes through pipe 80, fitting 82 to the external source-refrigerant heat exchanger 22 where heat is absorbed from the warmer external source causing the liquid low pressure refrigerant to vaporize. The refrigerant vapor enters the reversing valve 16 through fitting 64, pipe 66 and orifice 50 and is directed back to the compressor 14 via orifice 49, pipe 68 and entrance port 38, and the cycle is repeated.

During the start-up of the compressor in the hot water heating cycle the entrance port 38 of the compressor 14 evacuates the refrigerant from the piping 74, 72 and 70 extending between first bi-flow valve 26, through the refrigerant-air coil 54 of the refrigerant-air heat exchanger 20 and reversing valve 16 to the compressor for use in the hot water heating cycle. The independent opening and closing of the first and second bi-flow valves 26 and 28 allow for the evacuation of refrigerant from the refrigerant-air coil 54 of the refrigerant-air heat exchanger 20 when the temperature control device does not call for the heat pump to operate in either the heating or cooling cycle thereby assuring an adequate supply of refrigerant in the potable water heating cycle.

SEPARATE COILS/OFF PEAK OPERATION

Figures 4, 5:
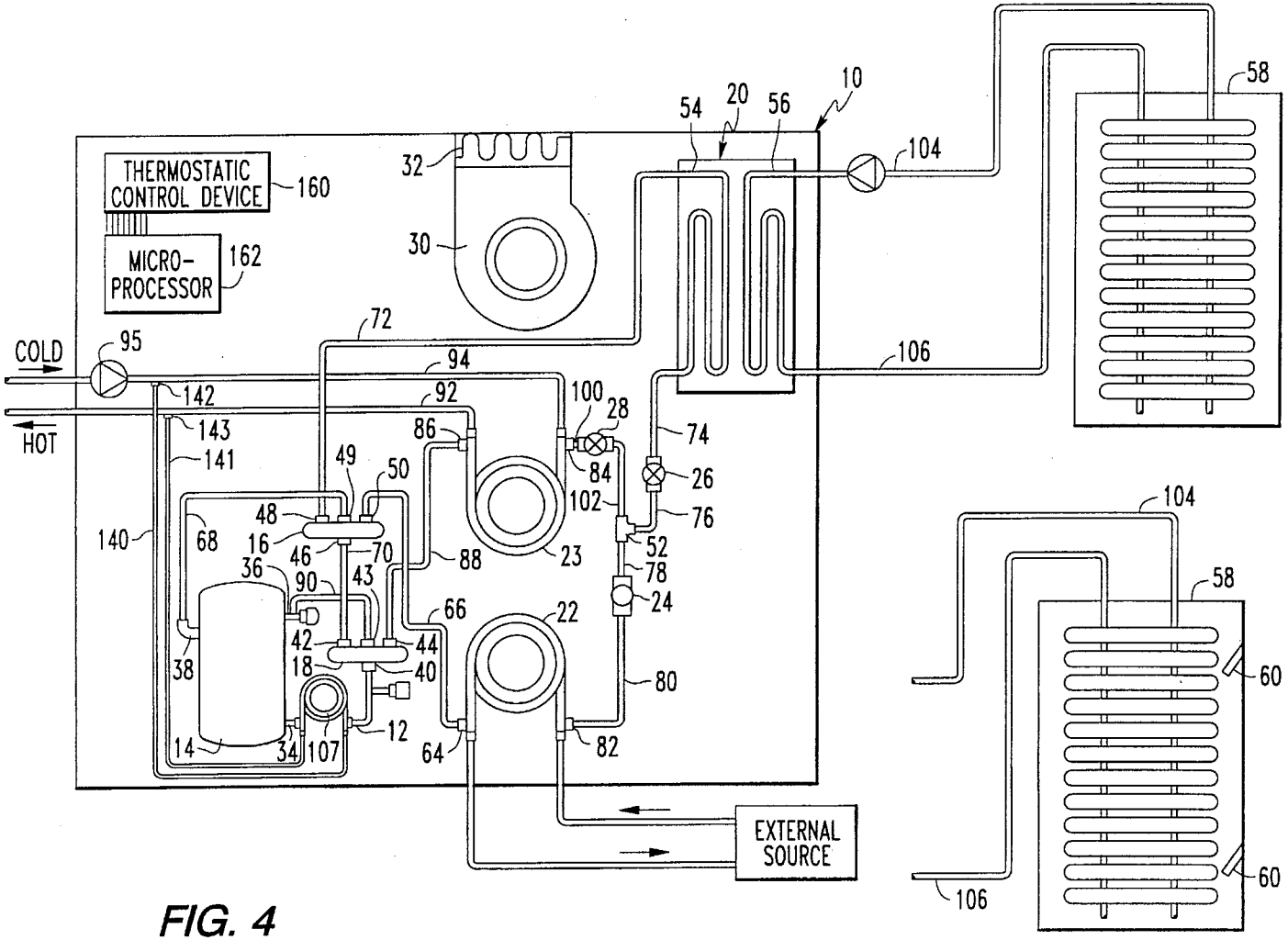
FIG. 4 is a diagram of the heat pump of the present invention including a thermal storage tank.
FIG. 5 is a thermal storage tank with electric resistance heating elements.

In a preferred embodiment, the refrigerant-air heat exchanger incorporates two separate coils, a refrigerant-air coil 54 and a liquid-air coil 56. The pair of separate coils allow for different modes of off-peak operation as shown in FIG. 4. Off-peak operation, as used herein, refers to that period of time when utility rates are lowest due to low demand.

FIG. 4 illustrates the heat pump unit operating in the off-peak hot water storage mode. The off-peak hot water storage mode includes a thermal liquid storage tank 58 connected to the liquid-air coil 56 of the refrigerant-air heat exchanger 20 by way of supply line 104 and return line 106. As shown in FIG. 5, a plurality of electric resistance heating elements 60 may be positioned within the thermal storage tank to heat the liquid contained therein. In a preferred embodiment, the liquid consists of an antifreeze mixture that does not freeze when the ambient temperature is below freezing. The liquid is heated by the electrical resistance heating elements 60 during off-peak hours. When called for by the thermostatic control, the liquid is circulated through supply line 104 to the liquid-air coil 56 of the refrigerant-air heat exchanger 20 and air from the conditioned space is blown over the liquid-air coil resulting in a transfer of heat to the conditioned space without the necessity of operating the compressor of the heat pump unit. The now cool liquid is returned to the storage tank 58 via return line 106.

An off-peak ice storage capability added to the heat pump unit is also shown in FIG. 4. The off-peak ice storage is provided by the operation of the heat pump in the cooling cycle as previously described during off-peak hours without the use of the fan. In the cooling cycle, cold liquid refrigerant in the refrigerant-air coils 54 of the heat exchanger 20 chills the liquid within the liquid-air circuit 56. The cold liquid is then stored in the thermal storage tank 58 until needed. The cold liquid, when the cycle is called for by the thermostatic control 160, is circulated from tank 58 through supply line 104 to the liquid-air circuit 56 of the refrigerant-air heat exchanger 20 where warm air from the conditioned space is blown through the refrigerant-air heat exchanger 20 to cool the conditioned space. The warm liquid is then returned to the tank 58 via return line 106.

The use of either the off-peak heating and off-peak cooling cycles of the heat pump results in increased savings to the consumer due to the capability of storing the heated or cooled liquid produced by the heat pump utilizing low utility rates.

Several advantages are attendant in the above described heat pump system. First, with the desuperheater 107 and microprocessor 162 to select appropriate cycles, the potable water can be heated to a higher temperature than before known in the art at lower compressor head pressures than before known in the art. Second, lower head pressures will result in longer compressor life. Third, the microprocessor of the present can select the most efficient mode or simultaneous combination of modes that will most efficiently utilize the heat in the vapor phase of the refrigerant exiting compressor 14 based upon the demands presented to the heat pump system at that time.

MICROPROCESSOR CONTROLLER

The microprocessor 162 shown in FIGS. 1–4, 6 and 7, and discussed briefly above, will be discussed in greater detail hereinafter.

Based upon a network of sensory inputs sensing several parameters, the microprocessor 162 of the heat pump unit 10 of the present invention will cycle on or off circulating pumps, air moving fans, reversing valve(s), hot gas diverting valve(s), heat transfer medium solenoids, and single or multi-speed/staged compressors and the like, as programmed to obtain the most efficient balance between the demands placed on the system and the system's various modes of operation. Parameters sensed by the sensory inputs include the temperatures of the refrigerant in its vapor and liquid phases in and out of the several heat exchangers described above (including here the desuperheater 107), the air temperature of the conditioned space, the water temperatures in and out of the several heat exchangers and water storage tanks and pipes as described above the temperature of the external source and various pipes associated therewith as described above, and signals from a remote thermostat.

In a preferred embodiment, microprocessor 162 is a single board microprocessor based controller operating on a power supply of 24 volts A/C current. Inputs include: a low pressure sensor for sensing system malfunction or loss of refrigerant, a high pressure sensor for sensing system malfunction or excessive refrigerant and at least four inputs from thermostatic control 160 for sensing room air conditioning requirements. In a preferred embodiment, all inputs are digitized and optically isolated. Optical isolation is preferred because it prevents the transmittance of electrical noise or static electricity from external input wiring causing damage to the solid state microprocessor controller.

In a preferred embodiment, microprocessor 162 receives at least seven temperature inputs in the form of digitized conversions of analog signals. These temperature inputs are provided by signals generated by solid state temperature sensors. These seven temperature inputs may include: (1) Source water temperature entering the heat pump for informational and control of loop pump #2; (2) Source water temperature leaving the heat pump for informational and freeze-up protection; (3) Air temperature entering the heat pump for informational and staging control; (4) Air leaving the heat pump for informational and troubleshooting; (5) Domestic hot water entering the heat pump for informational and control of water heating function; (6) Domestic water leaving the heat pump for informational and troubleshooting; (7) Suction temperature (refrigerant) for superheat computation; (8) Discharge temperature (refrigerant) for compressor over temperature protection; and (9) Liquid line temperature (refrigerant) for subcooling computation.

Microprocessor 162 also includes relay outputs to operate blower 30, reversing valves 16 and 18, electric heater 32, compressor 14, bi-flow valves 26 and 28, three way valves 96 and 124.

Microprocessor 162 further includes output indicators to display various system parameters. In a preferred embodiment, these outputs are LED lights. These output indicators include: (1) a high pressure lockout indicator to show when lockout exists due to high refrigerant pressure, (2) a low pressure lockout indicator to show when lockout exists due to low refrigerant pressure, (3) a hot water indicator to show when heat pump is in water heating mode, and (4) a freeze indicator to show when lockout exists due to low leaving water temperature, and (5) a high discharge gas temperature lockout indicator.

Microprocessor 162 further includes communication links to transfer its accumulated and stored data to maintenance and test terminals to be used for factory testing and initial setup, and field testing and repairs.

The software associated with microprocessor 162 performs four functions: 1) control of heat pump unit 10 during start-up and normal operations; 2) measurement of output of system parameters for calibration and repair; 3) emergency detection and overrides to control abnormal operations; and 4) processing, accumulation and presentation of temperature sensor data.

For example, during normal power up operations microprocessor 162 performs a short self-test and initializes the software program's variables. It will turn off all outputs. It will set a "compressor delay" to a preset value to ensure that the compressor 14 does not immediately restart if the power is momentarily lost in order to prevent failed starts (due to equalization of refrigerant pressure).

After normal operation has begun, microprocessor 162 will examine the process inputs at programmed intervals (usually about once per second) and execute the control algorithm for the system, and update the process outputs. As part of the control algorithm, the microprocessor 162 also updates the average and peak readings that are displayed in a diagnostics mode. The microprocessor 162 provides greater efficiency by determining which heat exchanger 107, 23, 22, 20, 98 or 58 or the like to use based upon the demands placed on heat pump unit 10 versus system operating parameters obtained from its sensory network such as the hot gas discharge temperature from compressor 14 and the entering water temperature at one or more of the heat exchangers and the like.

For example, the microprocessor software program provides a means for ensuring that heat pump unit 10 is operating at the highest level of efficiency by determining which of the heat exchangers to use for generating hot water: (1) either both the dedicated refrigerant-to-water heat exchanger 23 and the desuperheater 107; or (2) just the desuperheater 107. On a call for water heating, the software program determines if there is a simultaneous call for space heating or space cooling. If there is a simultaneous call for space conditioning and water heating, then the software program selects between the two modes of operation of: (1) water heating only or (2) space conditioning and water heating using the desuperheater 107. The selection is determined by the temperature of the water in the hot water storage tank 62 or similar device. If the temperature of the water in storage tank 62 has dropped to 100° F., for example, then the microprocessor 162 will select the dedicated water heating mode for rapid recovery of the hot water storage tank 62. As the recovery temperature reaches a programmed set point of 120° F., for example, then the software program selects the alternate mode of operation (water heating and space conditioning) to bring the hot water temperature to its maximum limit (130° F., for example) using the hot refrigerant superheated gas in the desuperheater 107 while still providing space conditioning. The software program allows these set points to be adjusted up or down according to the application and operating parameters.

The software program has the ability to continually sample the water temperature in the hot water storage tank 62 by energizing the hot water circulator pump 95 at programmed intervals, or whenever the compressor 14 is energized. The hot water circulator pump 95 moves water from the storage tank 62 through the dedicated refrigerant-to-water heat exchanger 23 and the desuperheater 107, allowing the water temperature to be measured by a thermistor strapped to the heat pump's incoming hot water tubing which supplies both refrigerant-to-water heat exchangers.

Above and beyond the software associated with the routine operation of the multi-function heat pump system, with its traffic management of inputs and outputs, the software includes the following novel features:

- Low voltage protection/shutdown
- Reversing valve shift on shutdown to prevent seize-up and equalize pressure from suction to discharge
- Four hour moving average temperature storage on all inputs, with delay on gathering for meaningful values
- High/low temperature storage on all inputs, with delay on gathering
- Refrigerant subcooling/superheat computation, with forced waiting for valid computations
- Factory adjustable, anti-short cycle compressor time delay
- Accumulative run hour storage independent for all modes
- Secondary source pump control based on incoming fluid temperature, with field-adjustable setpoints
- Defective or missing sensor warning
- Faulty thermostat input combination detection
- Adjustable hot water setpoint and differential with limits
- Staged fan speed control System configuration and calibration are performed when a terminal (not shown) is attached to the microprocessor's 162 communications port, whereupon the system can display diagnostic information. The terminal can be either associated with heat pump unit 10 or it can be at a remote location if it is in communication with heat pump unit 10, or both for a dual terminal system. Such diagnostic information is particularly useful to a service person. The microprocessor 162 can display on the terminal the value of all temperature and pressure inputs, all inputs, and all outputs. It can display the average and peak readings for all temperature inputs for a selected interval of time. Further, lockout time delay can be bypassed to allow the service person to cycle the compressor 14 as described form diagnosis or service, and average and peak values can be reset as required or desired.

Microprocessor 162 constantly monitors its own operation and the operation of heat pump unit 10 with a network of sensory inputs to ensure that both are operating within programmed parameters of safe operation. Should any one of several sensory inputs to the microprocessor 162 indicate a malfunction, or a malfunction of microprocessor 162 itself, an output signal is generated by microprocessor 162 to turn off the heat pump unit 10 or modify the mode of operation to avoid the malfunction. For example, when a fault is detected (such as excessively high pressure, excessively low pressure, or outlet freezing), the compressor 14 is turned off for a minimum time period specified by the "compressor delay" preset value, and remains off until reset is initiated. The exact cause of the malfunction can be displayed at the terminal associated with the heat pump unit 10 or at the remote terminal or both.

Further, the sophistication of the microprocessor 162 provides a unique advantage over the prior art by providing the ability to select and deselect various modes of operation (i.e., space heating, space cooling, water heating or combinations of these modes of operation) to provide greater efficiency and less down time. For example, microprocessor 162 can be programmed to identify a faulty mode of operation, and thus can prevent the heat pump unit 10 from operating in that faulty mode which exhibited the problem, while allowing operation in the other non-faulty modes. In other words, the multi-function heat pump unit 10 can operate independently in all modes in the sense that if one mode malfunctions or field conditions exist that trip a safety lockout in one particular mode of operation, the entire heat pump unit 10 is not disabled. The system is free to operate in the other modes, unless the failure or field condition is detrimental to the other modes.

Further unique and novel capabilities of the software program are its ability to incorporate compressor staging: to select high speed or low speed operation of a two speed compressor, or in the case of multiple compressors, select either one or more compressors to operate in the space heating, space cooling or water heating mode.

Microprocessor 162 of the heat pump unit 10 provides the ability to store operating information for future retrieval by a service person with a handheld remote terminal or computer. This virtually eliminates the frustration of parties involved when a service person fails to uncover problems with a system reported as being faulty by the owner. The microprocessor 162 has the ability to store and present information, including, but not limited to safety trip histories or safety lockout histories for each mode of operation, compressor run hours for each mode of operation, averages of all temperature sensor temperatures while in operation for each mode of operation, high/low temperature ranges of all temperature sensor temperatures while in operation for each mode of operation and the like.

Microprocessor 162 of the heat pump unit 10 provides the capability for a service person to obtain and monitor accurate, reliable system operating parameters via a remote terminal. With prior art heat pump units which did not include a microprocessor, a service person had to physically attach his or her own instrumentation to various locations on the heat pump requiring the service person to be in physical contact with the heat pump unit and introducing the chance for human or instrumentation error. Even where a service person had a sophisticated digital temperature measuring unit with remote sensors, such measuring units generally are of a one, two or three station variety. The service person would not be able to obtain simultaneous readings of all the points covered by the microprocessor 162 of the present invention and its network of sensory inputs.

One of the most important pieces of information required to properly diagnose a malfunctioning heat pump system is the degree of refrigerant gas superheat at the suction intake to the compressor 14, and the degree of refrigerant liquid subcooling at the entrance of the refrigerant central device 24, typically a thermal expansion valve. Only by knowing this information, can a service person be certain that a diagnosis is correct and/or that the heat pump is operating properly with the correct amount of refrigerant gas in the unit. The superheat and subcooling determination requires the field measurement of the compressor suction and discharge pressures and reference to a saturated temperature versus pressure table for that particular refrigerant. Usually, heat pump manufacturers provide the recommended superheat and subcooling values for their equipment to service personnel. Very seldom do service personnel measure and make a determination of system superheat and subcooling.

The microprocessor 162 of the heat pump unit 10 of the present invention, when used with the remote terminal described above, provides the refrigerant gas superheat and liquid subcooling values upon entry of the suction and discharge pressures to a service person remote from heat pump unit 10 via the remote terminal. The present invention eliminates the need for a service person to measure temperatures on the refrigeration tubing, refer to a refrigerant table, and make a computation to determine the degree of superheat and subcooling.

The microprocessor 162 of the heat pump unit 10 offers advantages over the prior art heat pump unit in the form of operational cost savings. One method utilized to reduce operating costs is by controlling the fan motor speed of blower 30. With recognition of the room thermostatic input at all times, the microprocessor 162 regulates the fan motor speed according to the degree of demand for space heating or air conditioning (cooling). The blower motor of blower 30 does not operate on its highest speed until the maximum demand is requested by the room thermostat, thus reducing overall fan motor energy consumption. The user also has the option of manually selecting the fan motor speeds independently for heating and cooling. Typically, this is accomplished via a set of dip switches included as part of microprocessor 162. The dip switches can also be used to manually select potable water circulator 95 pump sampling options and closed loop antifreeze protection with antifreeze fluid.

Another method utilized to reduce overall operating costs is by staging control of the source loop circulator pumps on a closed-loop (earth-coupled) system. When two or more pumps are required for the application, the microprocessor 162 stages the operation according to the source fluid temperature. This feature is very beneficial when the heat pump is operating between the space cooling mode and the water heating mode. For example, with a higher demand of space cooling, the source fluid temperature would be in the range of 75° to 100° F. This is well above the normal requirement for fluid temperatures for the water heating mode (40° to 60° F.). Therefore, with this scenario, very little fluid flow would be required when the heat pump was in the water heating mode. This staging process would normally be impractical with the prior art because of the difficulty and expense of installing temperature sensing switching devices (thermostats) and relays.

In addition, a ground source heat pump configuration as illustrated in FIG. 7, could have one single or a multitude of circulator pumps which could be cycled on or off as the demand for more gallons per minute (gpm) of transfer fluid (water or antifreeze solution) is needed to transfer heat (rejection or absorption) from the heat pump to the ground.

Finally, the microprocessor 162 also includes optically coupled inputs to eliminate problems associated with electrical noise.

Having described presently preferred embodiments of the invention, it is to be understood that it may be otherwise embodied within the scope of the appended claims.

We claim:

1. An improved heat pump unit for heating and cooling a conditioned space and for heating potable water, said heat pump unit of the type having a recirculating refrigerant, a compressor, a refrigerant-air heat exchanger, and an external source-refrigerant heat exchanger interconnected to recirculate said refrigerant and transfer heat from a low temperature reservoir to a higher temperature reservoir, wherein the improvement comprises:

a desuperheater adapted to be connected to a reservoir of potable water through inlet and outlet pipes for passage and heating of potable water therethrough;

a refrigerant-potable water heat exchanger adapted to be connected to a reservoir of potable water through inlet and outlet pipes for passage and heating of potable water therethrough;

a valve means, (a) when positioned for a dedicated potable water heating cycle, for circulating refrigerant from said compressor to at least one of said refrigerant-potable water heat exchanger and said desuperheater to heat potable water passing therethrough, and for then circulating said refrigerant to said external source-refrigerant heat exchanger for return to said compressor, and (b) when positioned for a combination potable water heating and space conditioning cycle, for circulating refrigerant from said compressor to said desuperheater to heat potable water passing therethrough, and for then circulating said refrigerant to either said refrigerant-air heat exchanger to said external-source refrigerant heat exchanger for return to said compressor for a space heating cycle or to said external source-refrigerant heat exchanger to said refrigerant-air heat exchanger for return to said compressor for a space cooling cycle, and (c) when positioned for a dedicated space cooling cycle, for circulating refrigerant from said compressor to said external source-refrigerant heat exchanger and then to said refrigerant-air heat exchanger for return to said compressor, and (d) when positioned for a dedicated space heating cycle, for circulating refrigerant from said compressor to said refrigerant-air heat exchanger and then to said external source-refrigerant heat exchanger for return to said compressor;

a sensory network for sensing various operational parameters of said heat pump unit; and a microprocessor, said microprocessor including a means for sensing a temperature of said reservoir of potable water and a means for sensing a temperature of said conditioned space and a means for processing and storing inputs from said sensory network, said microprocessor prioritizing simultaneous or non-simultaneous demands for potable water heating and space cooling or space heating, and activating said valve means to select between said dedicated potable water heating cycle, said combination potable water heating and space conditioning cycle, said dedicated space heating cycle and said dedicated space cooling cycle based upon said temperature of said reservoir of potable water, said temperature of said conditioned space and said operational parameters.

2. The improved heat pump unit as set forth in claim 1 wherein said valve means comprises a three-way valve, a reversing valve, a first bi-flow valve and a second bi-flow valve, wherein said three-way valve is connected to said desuperheater which is in turn connected to said compressor, said reversing valve is connected to said three-way valve and to said compressor through said desuperheater, said first bi-flow valve is interposed between said external source-refrigerant heat exchanger and said refrigerant-air heat exchanger and said second bi-flow valve is interposed between said external source-refrigerant heat exchanger and said refrigerant-potable water heat exchanger to form said dedicated potable water heating cycle, said combination potable water heating and space conditioning cycle, said dedicated space heating cycle, and said dedicated space cooling cycle.

3. The improved heat pump unit as set forth in claim 2, further comprising a refrigerant-control device, said refrigerant control device interposed between said external source-refrigerant heat exchanger and said first and said second bi-flow valves, said refrigerant-control device cooling said refrigerant as said refrigerant flows therethrough.

4. The improved heat pump unit as set forth in claim 1 further comprising a circulating pump and a hot water storage tank for said reservoir of potable water, said storage tank connected to said refrigerant-potable water heat exchanger and said desuperheater through inlet and outlet pipes for passage of potable water circulated therethrough by said circulating pump.

5. The improved heat pump unit as set forth in claim 1 further comprising a second three-way valve, a hot water storage tank, a circulating pump and a water-water heat exchanger, said circulating pump forcing potable water through said second three-way valve and to said hot water storage tank and to said water-water heat exchanger, wherein said water-water heat exchanger heats water for secondary use.

6. The improved heat pump unit as set forth in claim 1 wherein said refrigerant-air heat exchanger includes a refrigerant-air coil and a liquid-air coil, said refrigerant-air coil for heating and cooling air blown from the conditioned space over said refrigerant-air coil and for heating and cooling said liquid air coil.

7. The improved heat pump unit as set forth in claim 6 further comprising a liquid and a thermal liquid storage tank for storing liquid heated and cooled within said liquid-air coil said storage tank connected to said liquid-air coil through return and supply lines for storage of heated and cooled liquid therein.

8. The improved heat pump unit as set forth in claim 7 further comprising electric resistance heating elements, said heating elements positioned within said storage tank for heating said liquid within said storage tank.

9. The improved heat pump unit as set forth in claim 7 wherein said liquid is an antifreeze solution.

10. The improved heat pump unit as set forth in claim 9 wherein said antifreeze solution is ethylene glycol.

11. The improved heat pump unit as set forth in claim 7 further comprising a circulating pump, said circulating pump provided within said supply line for circulating liquid between said storage tank and said liquid-air coil.

12. The improved heat pump unit as set forth in claim 1 wherein said external source of said external source-refrigerant heat exchanger is air.

13. The improved heat pump unit as set forth in claim 1 wherein said external source of said external source-refrigerant heat exchanger is a liquid source, said heat exchanger transferring heat between said liquid source and said refrigerant.

14. The improved heat pump unit as set forth in claim 13 wherein said liquid source is water.

15. The improved heat pump unit as set forth in claim 13 wherein said liquid source is an antifreeze solution.

16. The improved heat pump unit as set forth in claim 15 wherein said antifreeze solution is ethylene glycol.

17. The improved heat pump unit as set forth in claim 13 further comprising a thermal liquid storage tank, a ground loop, a third three-way valve and a circulating pump, said liquid source circulated between said external source-refrigerant heat exchanger, said ground loop and said thermal storage tank by said circulating pump through said third three-way valve.

18. The improved heat pump unit as set forth in claim 1 wherein said sensed operational parameters of said heat pump unit and said sensed temperatures include a low pressure sensor, a high pressure sensor, a sensor to measure the temperature of source water entering said heat pump unit, a sensor for measuring the temperature of source water exiting said heat pump unit, a sensor for measuring the temperature of air entering said heat pump unit, a sensor for measuring the temperature of air exiting said heat pump unit, a sensor for measuring the temperature of source water exiting said heat pump unit, a sensor for measuring the temperature of potable water entering said heat pump unit, a sensor for measuring the temperature of potable water existing said heat pump unit, a refrigerant suction temperature sensor, a refrigerant discharge temperature sensor, a refrigerant liquid line temperature sensor and a sensor to measure the degree of refrigerant gas superheat at a suction intake of said compressor.

19. The improved heat pump unit as set forth in claim 1 wherein said microprocessor includes relay outputs to operate several components of said heat pump units.

20. The improved heat pump unit as set forth in claim 1 wherein said components include a blower, a reversing valve, one or more three-way valves, a compressor, a first bi-flow valve, a second bi-flow valve, and auxiliary electric heat relay and one or more circulating pumps.

21. The improved heat pump unit as set forth in claim 1 wherein said microprocessor further comprises output indicators to display system parameters.

22. The improved heat pump unit as set forth in claim 21 wherein said output indicators further comprise a high pressure lockout indicator, a low pressure lockout indicator, a potable water heating indicator, a freeze lockout indicator, high discharge gas temperature lockout indicator, a microprocessor malfunction indicator, and an erroneous input and low voltage indicator, and a defective or missing temperature sensor indicator.

23. The improved heat pump unit as set forth in claim 1 wherein said microprocessor further comprises one or more data communication links to transfer said processed and stored inputs received from said sensory network.

24. The improved heat pump unit as set forth in claim 23 wherein said data communication links transfer said processed and stored inputs to a video display terminal.

25. The improved heat pump unit as set forth in claim 24, wherein said video display unit is attached to said heat pump unit.

26. The improved heat pump unit as set forth in claim 24 wherein said video display terminal is remote from said heat pump unit.

27. The improved heat pump unit as set forth in claim 1 wherein said microprocessor further comprises a means to control said heat pump unit during start up operations.

28. The improved heat pump unit as set forth in claim 1 wherein said microprocessor further comprises a means to measure said operational parameters for calibration and repair.

29. The improved heat pump unit as set forth in claim 1 wherein said microprocessor further comprises a means to detect and override abnormal or dangerous operating conditions of said heat pump unit.

* * * * *

UNITED STATES PATENT AND TRADEMARK OFFICE

CERTIFICATE OF CORRECTION

PATENT NO. : 5,465,588

DATED : November 14, 1995

INVENTOR(S) : David I. McCahill and Gary E. Valli

It is certified that error appears in the above-indentified patent and that said Letters Patent is hereby corrected as shown below:

Column 1 Line 35 "phase," should read --phase;--.

Column 2 Line 32 "pressures)." should read --pressures").--.

Column 3 Line 1 "spaces;" should read --spaces,--.

Column 4 Line 40 "high pressures" should read --high pressure--.

Column 4 Line 44 "elements 32," should read --element 32,--.

Column 5 Line 20 "refrigerant-control" should read --refrigerant control--.

Column 5 Lines 66-67 "refrigerant-liquid heat exchanger 22" should read --external source-refrigerant heat exchanger 22--.

Column 6 Line 13 "from together" should read --together--.

Column 6 Line 61 "though" should read --through--.

Column 6 Line 63 "refrigerant-control" should read --refrigerant control--.

Column 7 Line 5 "refrigerant-control" should read --refrigerant control--.

UNITED STATES PATENT AND TRADEMARK OFFICE

CERTIFICATE OF CORRECTION

PATENT NO. : 5,465,588

DATED : November 14, 1995

INVENTOR(S) : David I. McCahill and Gary E. Valli

It is certified that error appears in the above-indentified patent and that said Letters Patent is hereby corrected as shown below:

Column 7 Line 49 "refrigerant air" should read --refrigerant-air--.

Column 8 Line 4 "refrigerated-potable" should read --refrigerant-potable--.

Column 8 Line 47 "discharges" should read --discharge--.

Column 9 Line 4 "refrigerant-water" should read --refrigerant-potable water--.

Column 9 Line 6 "at" should read --as--.

Column 9 Line 9 "140° F. The" should read --140° F.) The--.

Column 9 Line 25 "to place" read --to a place--.

Column 9 Line 26 "usage via and returned through pipe" should read --usage via pipe--.

Column 9 Line 54 "potable" should read --refrigerant-potable--.

Column 10 Line 12 "refrigerant-control" should read --refrigerant control--.

Column 11 Line 6 "refrigerant-air coils" should read --refrigerant-air coil--.

Column 11 Line 7 "circuit" should read --coil--.

UNITED STATES PATENT AND TRADEMARK OFFICE

CERTIFICATE OF CORRECTION

PATENT NO. : 5,465,588

DATED : November 14, 1995

INVENTOR(S) : David I. McCahill and Gary E. Valli

It is certified that error appears in the above-indentified patent and that said Letters Patent is hereby corrected as shown below:

Column 11 Line 11 "circuit" should read --coil--.

Column 11 Line 54 after "above" insert --,--.

Column 12 Line 21 "electric heater" should read --electric resistance heating element--.

Column 13 Line 29 "circulator pump" should read --circulating pump--.

Column 13 Line 31 "circulator pump" should read --circulating pump--.

Column 14 Line 9 "form" should read --from--.

Column 15 Line 16 "central" should read --control--.

Column 15 Line 54 "circulator 95 pump" should read --circulating pump 95--.

Claim 1(b) Lines 49-50 Column 16 "external-source refrigerant" should read --external source-refrigerant--.

Claim 3 Line 32 Column 17 "refrigerant-control" should read --refrigerant control--.

Claim 3 Line 35 Column 17 "refrigerant-control" should read --refrigerant control--.

Claim 6 Line 57 Column 17 "liquid air" should read --liquid-air--.

UNITED STATES PATENT AND TRADEMARK OFFICE

CERTIFICATE OF CORRECTION

PATENT NO. : 5,465,588

DATED : November 14, 1995

INVENTOR(S) : David I. McCahill and Gary E. Valli

It is certified that error appears in the above-indentified patent and that said Letters Patent is hereby corrected as shown below:

Claim 7 Line 61 Column 17 "coil said" should read --coil, said--.

Claim 18 Line 43 Column 18 "existing" should read --exiting--.

Claim 20 Line 54 Column 18 "and auxiliary" should read --an auxiliary--.

Signed and Sealed this

Twenty-sixth Day of March, 1996

*Attest:*

Bruce Lehman

BRUCE LEHMAN

*Attesting Officer*

*Commissioner of Patents and Trademarks*